US007766985B2

(12) United States Patent
Iijima et al.

(10) Patent No.: US 7,766,985 B2
(45) Date of Patent: Aug. 3, 2010

(54) COAL DRYING METHOD AND EQUIPMENT, METHOD FOR AGING REFORMED COAL AND AGED REFORMED COAL, AND PROCESS AND SYSTEM FOR PRODUCING REFORMED COAL

(75) Inventors: Masaki Iijima, Tokyo (JP); Kiyomichi Taoda, Hiroshima (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 12/382,382

(22) Filed: Mar. 16, 2009

(65) Prior Publication Data

US 2009/0178332 A1 Jul. 16, 2009

Related U.S. Application Data

(62) Division of application No. 10/932,014, filed on Sep. 2, 2004, now Pat. No. 7,524,341, which is a division of application No. 10/053,648, filed on Jan. 24, 2002, now abandoned, which is a division of application No. 09/561,347, filed on Apr. 28, 2000, now abandoned, which is a division of application No. 09/045,792, filed on Mar. 23, 1998, now Pat. No. 6,068,671.

(30) Foreign Application Priority Data

Mar. 31, 1997 (JP) ..... 1997/096582
Mar. 31, 1997 (JP) ..... 1997-096583
Mar. 31, 1997 (JP) ..... 1997/096584

(51) Int. Cl.
*C10L 5/00* (2006.01)

(52) U.S. Cl. ..... 44/626; 44/621

(58) Field of Classification Search ..... 44/621, 44/626
See application file for complete search history.

(56) References Cited

U.S. PATENT DOCUMENTS 4,101,265 A 7/1978 Broach et al.

(Continued)

FOREIGN PATENT DOCUMENTS

EP 0 758 677 2/1997

(Continued)

OTHER PUBLICATIONS

Patent Abstract of Japan, 551618892 A. Dec. 16, 1990, Yoshibumi et al., "Heat-Treatment of Coal".

(Continued)

*Primary Examiner*—Cephia D Toomer
(74) *Attorney, Agent, or Firm*—Foley & Lardner LLP

(57) ABSTRACT

In drying coal to be used as fuel for a coal-fired boiler, the coal is dried at a temperature of 80 to 150° C. by using combustion exhaust gas having passed through an air heater for the coal-fired boiler. Moreover, after medium-quality or low-quality coal is heated to a temperature of 300 to 500° C. at a heating rate of not less than 100° C. per minute and then cooled to a temperature of 250° C. or below at a cooling rate of not less than 50° C. per minute, the resulting reformed coal is cooled to a temperature of 70° C. or below and stored for 1 month or more in a state of isolation from the atmosphere. In producing the aforesaid reformed coal, the medium-quality or low-quality coal is heated by using combustion exhaust gas obtained at the outlet of an economizer included in the coal-fired boiler equipment or at the outlet of a denitrator included therein.

2 Claims, 3 Drawing Sheets

U.S. PATENT DOCUMENTS

| | | | |
|---|---|---|---|
| 4,247,302 | A | 1/1981 | Woldy et al. |
| 4,284,476 | A | 8/1981 | Wagener et al. |
| 4,396,394 | A | 8/1983 | Li et al. |
| 4,761,162 | A | 8/1988 | Ratcliffe et al. |
| 5,137,539 | A | 8/1992 | Bowling |

FOREIGN PATENT DOCUMENTS

| | | | |
|---|---|---|---|
| JP | 55-161892 | | 12/1980 |
| JP | 56-070093 | | 6/1981 |
| JP | 56-142318 | | 11/1981 |
| JP | 56157494 | * | 12/1981 |
| JP | 58-142981 | | 8/1983 |
| JP | 62-050393 | | 3/1987 |
| JP | 03-117807 | | 5/1991 |
| JP | 08-296835 | | 11/1996 |

OTHER PUBLICATIONS

Patent Abstract of Japan, 56070093 A, Jun. 11, 1981, Fumiaki, et al., "Heat-Treating Method of Coal".

* cited by examiner

COAL DRYING METHOD AND EQUIPMENT, METHOD FOR AGING REFORMED COAL AND AGED REFORMED COAL, AND PROCESS AND SYSTEM FOR PRODUCING REFORMED COAL

The application is a division of Ser. No. 10/932,014 filed Sep. 2, 2004, now U.S. Pat. No. 7,524,341, which is a division of Ser. No. 10/053,648, filed Jan. 24, 2002, now abandoned, which is a division of Ser. No. 09/561,347, filed Apr. 28, 2000, now abandoned, which is a division of Ser. No. 09/045,792, filed Mar. 23, 1998, now U.S. Pat. No. 6,068,671.

BACKGROUND OF THE INVENTION

1. Background of the First Group of the Present Invention

The first group of the present invention relates to a method for drying coal by utilizing waste heat from a coal-fired boiler using coal (in particular, medium-quality or low-quality coal) as fuel, and to drying equipment therefor.

Medium-quality and low-quality coals are those types of coal which have a low degree of coalification, and typical examples thereof include high-volatile sub-bituminous coal and brown coal. Since they are found in abundance and most of them have a low sulfur content, it is believed that their use will increase in the future.

However, medium-quality and low-quality coals have a high moisture content. If they are burned in a highly moist state, a considerable heat loss results owing to the sensible heat of the moisture and its latent heat of vaporization. Accordingly, the calorific value per unit weight is so low as to cause an increase in transport cost. Moreover, they have the disadvantage of being highly hygroscopic and liable to spontaneous combustion. These problems have constituted an obstacle to the expansion of their utilization.

Thus, there has been employed a method for drying such medium-quality or low-quality coal by heating it to a temperature of 80 to 150° C. at the colliery (or the site of coal mining) (this method is also called "ordinary drying"). Most of the dried medium-quality and low-quality coals have been consumed at the colliery for purposes of electric power generation and the like, while only a small portion thereof has been sold and transported to consumers in its neighborhood, and used thereby. In short, it has not been common practice to transport or store dried coal derived from medium-quality or low-quality coal, because this has a risk of spontaneous combustion.

Generally, in coal-fired boiler equipment, air heated by an air heater is introduced into a coal pulverizer where coal is dried and pulverized. The resulting pulverized coal is pneumatically conveyed to the burner and burned as boiler fuel.

2. Background of the Second Group of the Present Invention

The second group of the present invention relates to coal having low spontaneous combustibility, low hygroscopicity and a high calorific value which is obtained by heating medium-quality or low-quality coal to a high temperature, cooling it, and then subjecting the resulting reformed coal to an aging treatment, and to a method for producing the same.

Medium-quality and low-quality coals are those types of coal which have a low degree of coalification, and typical examples thereof include brown coal and high-volatile sub-bituminous coal. Usually, coals having a rank equal to or lower than sub-bituminous coal are called medium-quality and low-quality coals. Since they are found in abundance and most of them have a low sulfur content, it is believed that their use will increase in the future. However, medium-quality and low-quality coals have a high moisture content and hence a low calorific value per unit weight. Moreover, when dried, medium-quality and low-quality coals have the disadvantage of being highly hygroscopic and liable to spontaneous combustion. These problems have constituted an obstacle to the expansion of their utilization.

Accordingly, as described previously, there has been employed a method for drying such medium-quality or low-quality coal at a temperature of 80 to 150° C. (this method is also called "ordinary drying"). However, when coal is dried according to this method, the resulting dried coal shows an increase in spontaneous combustibility and, moreover, still has high hygroscopicity. Consequently, this dried coal tends to absorb atmospheric moisture during transportation and storage, and return to its original state freed of surface moisture alone (i.e., its original internal moisture content before drying). Moreover, owing to its high spontaneous combustibility, this dried coal is unsuitable for transportation and storage and has been limited to use at the site of coal mining (e.g., for purposes of electric power generation).

Moreover, in order to evaporate moisture, decompose hydrophilic oxygen-containing groups, and prevent the volatilization of tar, another method wherein coal is dried at a temperature of 180 to less than 300° C. is known. However, as contrasted with the reformed coal produced by the above-described method comprising rapid heating to a high temperature and subsequent cooling, the reformed coal produced by this method fails to show a sufficient improvement in calorific value and long-term spontaneous combustibility.

Furthermore, Japanese Patent Publication No. 11596/'82 discloses still another method for producing reformed coal by heating medium-quality or low-quality coal rapidly to a temperature of 300 to 500° C. and then cooling it rapidly. This method brings about a substantial improvement in spontaneous combustibility and a marked increase in calorific value due to dewatering, but fails to achieve sufficient stability of spontaneous combustion properties. Consequently, in order to prevent the spontaneous combustion of the resulting coal, a prudent measure needs to be taken under general consideration.

Thus, even if any of the conventional methods is employed, it has been difficult to produce reformed coal having desirable properties such as low spontaneous combustibility, low hygroscopicity and a high calorific value, from medium-quality or low-quality coal.

3. Background of the Third Group of the Present Invention

The third group of the present invention relates to a process for producing reformed coal having low hygroscopicity, a high calorific value and low spontaneous combustibility by heating medium-quality or low-quality coal to a high temperature and then cooling it, wherein the reformed coal is produced by utilizing hot exhaust gas from a coal-fired boiler and equipment for treating such exhaust gas.

Since medium-quality and low-quality coals are found in abundance and most of them have a low sulfur content, it is believed that their use will increase in the future. However, medium-quality and low-quality coals have a high moisture content and hence a low calorific value per unit weight. Moreover, when dried, medium-quality and low-quality coals have the disadvantage of being liable to spontaneous combustion and highly hygroscopic. These problems have constituted an obstacle to the expansion of their utilization.

Accordingly, as described previously, Japanese Patent Publication No. 11596/'82 discloses a method for producing reformed coal by heating medium-quality or low-quality coal rapidly to a temperature of 300 to 500° C. and then cooling it rapidly. Moreover, Japanese Patent Laid-Open No. 70093/'81 discloses a method for producing reformed coal by heating medium-quality or low-quality coal rapidly to a temperature of 300 to 500° C. and then cooling it rapidly, wherein the raw coal is dried by using a gaseous mixture composed of hot air obtained by subjecting air to heat exchange with the exhaust gas having been used for the rapid heating purpose and part of the hot gas for rapid heating use, so that the reformed coal can be advantageously produced from the viewpoint of thermal efficiency. Furthermore, as described previously, still another method for producing reformed coal is known. In this method, coal is dried at a temperature of 180 to less than 300° C. in order to evaporate moisture, decompose hydrophilic oxygen-containing groups, and prevent the volatilization of tar.

In any of the above-described methods for producing reformed coal having low hygroscopicity, a high calorific value and low spontaneous combustibility from medium-quality or low-quality coal, combustion gas from an installed gas is used and, moreover, a cooling gas is used as a diluent gas for controlling the temperature of the combustion gas. However, this cannot be regarded as economical from the viewpoint of equipment construction and thermal efficiency.

SUMMARY OF THE INVENTION

The first group of the present invention has been made against the above-described background. In the case of coal and, in particular, medium-quality or low-quality coal having a high moisture content, it cannot be fully dewatered (or dried) on the basis of heat balance. According, an object of this first group is to dry coal preliminarily by utilizing the heat of boiler exhaust gas obtained at a point downstream of an air heater, and thereby dewater the coal more fully and achieve an improvement in the efficiency of its utilization. To this end, the first group of the present invention provides an efficient coal drying method and drying equipment therefor.

The first group of the present invention has been made in view of the above-described existing state of the art. The present inventors have now found that, when coal (in particular, medium-quality or low-quality coal) is dried by utilizing waste heat from a coal-fired boiler using coal (medium-quality or low-quality coal) for fuel, coal having a high calorific value can be obtained and, moreover, such coal can be burned with high thermal efficiency by using it immediately thereafter. The first group of the present invention has been completed on the basis of this finding.

Thus, the first group of the present invention provides a coal drying method employed for the purpose of drying coal (in particular, medium-quality or low-quality coal) to be used as fuel for a coal-fired boiler, which comprises drying the medium-quality or low-quality coal at a temperature of 80 to 150° C. by using combustion exhaust gas having passed through an air heater for the coal-fired boiler, as well as such a coal drying method in which the combustion exhaust gas having been used for the drying purpose is fed to and treated by an electrostatic precipitator for the coal-fired boiler.

Moreover, the first group of the present invention also provides coal drying equipment comprising a coal-fired boiler, an air heater for effecting heat exchange between combustion exhaust gas from the coal-fired boiler and combustion air for the coal-fired boiler, and a dryer for drying coal by feeding thereto the combustion exhaust gas having passed through the air heater.

The first group of the present invention makes it possible to use medium-quality or low-quality coal as raw coal and produce therefrom highly calorific coal to be self-consumed in coal-fired boiler equipment, in an advantageous manner from the viewpoint of equipment construction and thermal efficiency. Moreover, the dried coal obtained by utilization of the coal-fired boiler may be fed to the furnace thereof while remaining hot. Furthermore, by equipping the coal-fired boiler with an auxiliary furnace, dried coal may be produced in an amount greater than the self-consumed amount.

The second group of the present invention has been made in view of the above-described existing state of the art, and an object thereof is to obtain reformed coal having desirable properties such as low spontaneous combustibility, low hygroscopicity and high calorific value, from medium-quality or low-quality coal.

The present inventors have now found that, when reformed coal produced by heating raw coal rapidly to a high temperature and then cooling it rapidly is aged under specific conditions, reformed coal having low spontaneous combustibility and retaining low hygroscopicity can be obtained. The second group of the present invention has been completed on the basis of this finding.

Thus, the second group of the present invention provides a method for aging reformed coal produced by heating medium-quality or low-quality coal to a temperature of 180 to less than 300° C. and then cooling it to a temperature of 150° C. or below, or by heating medium-quality or low-quality coal to a temperature of 300 to 500° C. at a heating rate of not less than 100° C. per minute and then cooling it to a temperature of 250° C. or below at a cooling rate of not less than 50° C. per minute, which comprises cooling the reformed coal to a temperature of 70° C. or below, and storing the reformed coal for 1 month or more in a state of isolation from the atmosphere, as well as aged reformed coal obtained in this manner.

Moreover, the second group of the present invention also provides a method for aging reformed coal which comprises storing the aforesaid reformed coal for 1 month or more under any of the following atmospheres (a) and (b), as well as aged reformed coal obtained in this manner.

(a) An atmosphere having an oxygen concentration of not greater than 12% by volume and a temperature of 100° C. or below.

(b) An atmosphere having an oxygen concentration of not greater than 21% by volume and a temperature of 70° C. or below.

Thus, when reformed coal produced by heating raw coal rapidly to a high temperature and then cooling it rapidly is aged according to the second group of the present invention, it is possible to reduce its spontaneous combustibility while maintaining its low hygroscopicity and high calorific value.

The third group of the present invention has been made in view of the above-described existing state of the art, and an object thereof is to provide a process for producing reformed coal wherein, by utilizing combustion exhaust gas and heat from a coal-fired boiler, reformed coal having low hygroscopicity, a high calorific value and low spontaneous combustibility can be produced from medium-quality or low-quality coal in an advantageous manner from the viewpoint of equipment construction and thermal efficiency.

The present inventors have now found that, when medium-quality or low-quality coal is reformed by using hot combustion exhaust gas (hereinafter also referred to briefly as "exhaust gas") obtained at the outlet of the economizer, denitrator or air heater included in coal-fired boiler equipment and, moreover, the reformed coal is cooled by using exhaust gas obtained at the outlet of the electrostatic precipitator or at a like point, the reformed coal can be produced in an advantageous manner from the viewpoint of equipment construction and thermal efficiency. The third group of the present invention has been completed on the basis of this finding.

Thus, the third group of the present invention provides a process and system for producing reformed coal by heating medium-quality or low-quality coal to a temperature of 180 to less than 300° C. and then cooling it to a temperature of 150° C. or below or by heating medium-quality or low-quality coal to a temperature of 300 to 500° C. at a heating rate of not less than 100° C. per minute and then cooling it to a temperature of 250° C. or below at a cooling rate of not less than 50° C. per minute, wherein the medium-quality or low-quality coal is heated and reformed by using exhaust gas obtained at the outlet of the economizer, denitrator or air heater included in coal-fired boiler equipment, the medium-quality or low-quality coal serving as the raw material for reformed coal is dried by using the exhaust gas having been used for the reforming purpose, the exhaust gas having been used for the drying purpose is fed to and treated by the electrostatic precipitator included in the coal-fired boiler equipment, and the coal reformed by heating is cooled by using exhaust gas obtained at the outlet of the electrostatic precipitator included in the coal-fired boiler equipment or at a point downstream thereof.

Moreover, the third group of the present invention also provides a process and system for producing reformed coal wherein the coal-fired boiler is equipped with a coal-fired auxiliary furnace, and hot exhaust gas from the auxiliary furnace is used in admixture with the exhaust gas obtained at the outlet of the economizer, denitrator or air heater.

According to the third group of the present invention, by using exhaust gas obtained at the outlet of an economizer for a coal-fired boiler, reformed coal can be produced from medium-quality or low-quality coal in an advantageous manner from the viewpoint of equipment construction and thermal efficiency. Moreover, the production of reformed coal for commercial use can be increased by installing an auxiliary furnace and reformed coal of better quality can be obtained by controlling the reforming temperature properly.

DETAILED DESCRIPTION OF THE PREFERRED EMBODIMENTS

1. First Group

Figure 1:
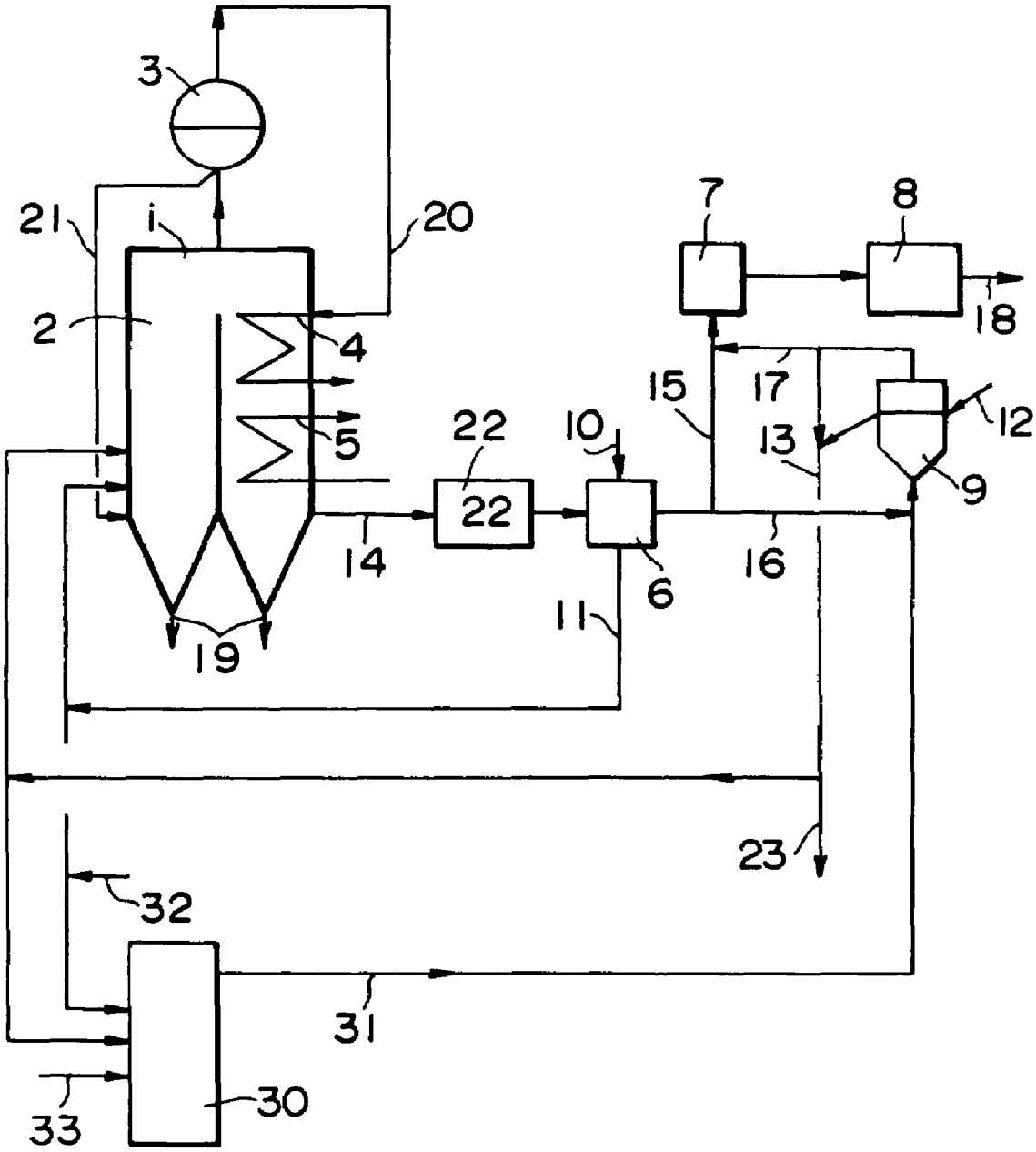
FIG. 1 is a block flow sheet illustrating one embodiment of the drying equipment in accordance with the first group of the present invention.

In the first group of the present invention, the term "medium-quality or low-quality coal" refers to coal having a total moisture content of not less than 10% by weight, a carbon content of not greater than 80% by weight on a dry ash-free (hereinafter referred to as "d.a.f.") basis, and an equilibrium moisture content of not less than 8% by weight. Specific examples thereof include brown coal and high-volatile sub-bituminous coal.

The total moisture of medium-quality or low-quality coal consists of surface moisture and internal moisture (called "equilibrium moisture"). The surface moisture can be removed even by drying at 100° C. or below. The equilibrium moisture can be reduced to about one-half by drying at a temperature of 80 to 150° C. A higher degree of heating enables the moisture content of medium-quality or low-quality coal to the vicinity of 0%.

At the time of heating, the temperature of the coal itself ranges from about 80 to 105° C. Consequently, with consideration for the ignitability of the coal, the drying gas should have a temperature of 100 to 300° C. and an oxygen concentration of not greater than 21%, preferably not greater than 12%, and most preferably not greater than 4%, though the oxygen concentration may depend on the temperature. Accordingly, it is preferable to use combustion exhaust gas (hereinafter referred to briefly as "exhaust gas") as the drying gas.

As to the amount of gas used for the drying purpose, a large volume of gas is required if the gas temperature is low, and this is disadvantageous from the viewpoint of equipment size and the like. The treating time is reduced as the gas temperature becomes higher, but the risk of ignition of the dried coal is increased at high oxygen concentrations.

The dryer used for this purpose should preferably be of the continuous type. There may be used any of various dryers such as fluidized bed dryers, circulation dryers and rotary kiln dryers.

Raw coal may be dried as such. However, where a fluidized bed dryer is used, it is preferable to dry raw coal after it is crushed to a particle size of 0.1 to 2 inches. The superficial gas velocity in the fluidized bed dryer is suitably in the range of 4 to 10 m/sec. The residence time may range from 2 to 10 minutes, and a residence time of 1 minute will be sufficient for coal having a particle size of 1 mm or less.

The moisture content of the resulting dried coal is reduced by 40 to 80%, as compared with the medium-quality or low-quality coal used as the raw material.

Now, one embodiment of the first group of the present invention is described below with reference to FIG. 1.

A coal-fired boiler 1 is equipped with a furnace 2, a steam drum 3, a superheater 4 and an economizer 5. Steam 20 generated in furnace 2 is subject to gas-liquid separation in steam drum 3. The separated steam is passed through superheater 4 and the resulting superheated steam is fed to a steam turbine. After the steam is used to drive the steam turbine, the resulting condensate is added to the circulating water 21 of the boiler, recycled to furnace 2, and evaporated again.

Combustion gas from coal-fired boiler 1 passes through economizer 5, and the resulting economizer outlet exhaust gas 14 is fed to an air heater 6 by way of a denitrator 22. Economizer 5 reheats the steam from the turbine, and the resulting steam is fed to steam drum 3.

As combustion air for coal-fired boiler 1, there is used air 11 comprising air 10 leaving air heater 6 after being heated therein by heat exchange with combustion exhaust gas 14 from the boiler. Ash 19 resulting from combustion is discharged from the bottom of coal-fired boiler 1.

Part of the combustion exhaust gas having undergone heat exchange in air heater 6 is fed, as exhaust gas 15, to a dust collector (e.g., electrostatic precipitator) 7 and then to a desulfurizer 8. The remainder is fed, as drying exhaust gas 16, to a dryer 9 and used to dry raw coal 12. After a small amount of entrained coarse particles are separated and removed by means of a cyclone (not shown), the resulting exhaust gas 17 may be fed to electrostatic precipitator 7 for coal-fired boiler 1, or may be added to the combustion air for the boiler and used for purposes of combustion. The particles separated by the cyclone (not shown) are fed to a pulverizer (not shown) and used as fuel for coal-fired boiler 1.

On the other hand, medium-quality or low-quality coal 12 serving as a raw material is fed to a dryer 9 where it is heated by the aforesaid drying exhaust gas 16. The resulting dried coal 13 is fed as fuel for coal-fired boiler 1.

According to another embodiment of the first group of the present invention, the exhaust gas having been treated by electrostatic precipitator 7 or the exhaust gas 18 having been treated by desulfurizer 8 may be reheated and used as a drying gas having a low oxygen concentration. Moreover, the temperature of the drying gas may be raised by mixing it with combustion exhaust gas 14 having passed through economizer 15.

Alternatively, instead of using combustion exhaust gas directly as a drying gas, air heated by heat exchange with combustion exhaust gas may be used for drying purposes.

Furthermore, according to still another embodiment of the first group of the present invention, coal-fired boiler 1 may be equipped with an auxiliary furnace 30, and hot combustion exhaust gas 31 from auxiliary furnace 30 may be mixed with the aforesaid drying exhaust gas 16 to increase the drying throughput of medium-quality or low-quality coal. Thus, part of the resulting dried coal may be cooled to obtain dried coal 23 for commercial use. Hot combustion exhaust gas 31 having an oxygen concentration of not greater than 12% by volume may be fed to dryer 9, either as such or after being diluted with a medium-temperature or low-temperature exhaust gas obtained at any of various steps of the coal-fired boiler equipment. It is to be understood that undried medium-quality or low-quality coal may be used as fuel for the auxiliary furnace.

In addition, dried coal 13, either as such or after being pulverized, may be fed to and burned in the furnace of coal-fired boiler 1, or both the furnace of coal-fired boiler 1 and auxiliary furnace 30, without substantially cooling it. Thus, dried coal 13 can be in a heated state and without any reduction in calorific value due to moisture absorption, so that high thermal efficiency can be achieved. For use in auxiliary furnace 30, other air 32 and other fuel 33 may also be fed thereto.

Consequently, by installing dryer 9 in close vicinity to the feed port of the pulverizer of furnace 2, it is possible to dry the amount of coal required for use as fuel for the coal-fired boiler, feed the dried coal directly to the furnace, and burn it therein.

In the first group, the present invention may be applied to the purpose of drying not only medium-quality and low-quality coals but also common coal.

EXAMPLES 1-5

The first group of the present invention is more specifically explained with reference to the following examples. However, it is to be understood that the first group of the present invention is not limited thereto.

Properties of raw coal and dried coal were evaluated according to the following methods.

Equilibrium moisture: This was determined by placing a sample of heat-treated coal in a saturated saline solution desiccator (with a relative humidity of 75%) and then testing it according to JIS M8812.

Volatile matter: This was determined according to JIS M8812.

Calorific value: This was determined according to JIS M8814.

Example 1

Properties of raw coal and exhaust gas which were used for the drying purpose were as shown below.

In the system illustrated in FIG. 1, a fluidized bed dryer was used as the dryer. Using part of the combustion exhaust gas (at 155° C.) leaving the air heater for the coal-fired boiler, raw coal which had been crushed to a particle diameter of not greater than 1 inch was heated and dried at a raw coal feed rate of 1.0 t/hr, a drying exhaust gas feed rate of 15,000 $m^3$/hr, and a residence time of 3 minutes.

The exhaust gas having been used for the drying purpose was freed of relatively coarse particles by means of a cyclone, and then fed to the electrostatic precipitator included in the equipment for treating combustion exhaust gas from the coal-fired boiler. The coarse particles separated by the cyclone were pulverized and fed to the furnace of the boiler as fuel.

(Low-quality Raw Coal)
Temperature: 17° C.
Total moisture: 29.6 wt. %
Equilibrium (internal) moisture: 23.5 wt. %
Ash: 6.8 wt. %
Volatile matter: 35.3 wt. %
Fixed carbon: 34.4 wt. %
Calorific value (on an equilibrium moisture basis): 4,800 kcal/kg (Drying Exhaust Gas)
Temperature: 155° C.
Oxygen: 6.9 vol. %
Moisture: 10.4 vol. %

Properties of the dried coal were as follows.
Temperature: 92° C.
Total moisture: 9.8 wt. %
Calorific value: 5,500 kcal/kg Thus, coal having a higher calorific value could be obtained by utilizing relatively low-temperature exhaust gas from the boiler.

The hot coal thus obtained was fed to the coal-fired boiler without allowing it to cool or absorb moisture, and used as fuel therefor.

The addition of this drying step caused no dust to be scattered into the atmosphere.

According to another related embodiment, all of the combustion exhaust gas obtained at the outlet of the air heater may be used as the drying gas.

Example 2

The procedure of Example 1 was repeated, except that raw coal having the following properties was used at a feed rate of 0.9 t/hr.

(Raw Coal)
Temperature: 22° C.
Total moisture: 29.0 wt. %
Equilibrium (internal) moisture: 18.7 wt. %
Ash: 24.3 wt. %
Volatile matter: 33.8 wt. %
Fixed carbon: 23.2 wt. %
Calorific value (on an equilibrium moisture basis): 3,400 kcal/kg Properties of the dried coal were as follows.
Temperature: 90° C.
Total moisture: 8.2 wt. %
Calorific value (on an equilibrium moisture basis): 3,820 kcal/kg Example 3

The procedure of Example 1 was repeated, except that a drying exhaust gas having the following properties was prepared by adding hot gas having bypassed the economizer and the air heater to gas leaving the air heater, and that the drying exhaust gas feed rate and the residence time were altered to 15,000 $m^3$/hr and 4 minutes, respectively.

(Drying Exhaust Gas)

Temperature: 180° C.

Oxygen: 6.8 vol. %

Moisture: 10.4 vol. %

Properties of the dried coal were as follows.

Temperature: 94° C.

Total moisture: 8.3 wt. %

Calorific value (on an equilibrium moisture basis):

5,600 kcal/kg

Example 4

The procedure of Example 1 was repeated, except that after the exhaust gas having been used for the drying purpose was freed of relatively coarse particles by means of a cyclone, one half of the exhaust gas was fed to the electrostatic precipitator included in the equipment for treating combustion exhaust gas from the coal-fired boiler while the other half was treated by mixing it with combustion air for the boiler furnace. Thus, substantially the same dried coal was obtained. The denitration, dedusting and desulfurization steps included in the equipment for treating combustion exhaust gas from the coal-fired boiler could treat exhaust gas without any problem.

Example 5

The same raw coal as used in Example 1 was burned in the same type of coal-fired boiler as used in Example 1. In order to increase the production of dried coal, an auxiliary furnace for generating a coal-heating gas was installed.

Properties of combustion exhaust gas from the auxiliary furnace were as shown below.

(Drying Combustion Exhaust Gas from Auxiliary Furnace)

Temperature: 950° C.

Oxygen: 11.5 vol. %

Moisture: 7.5 vol. %

15,000 $m^3$/hr of combustion exhaust gas (at 150° C.) leaving the air heater for the coal-fired boiler was mixed with 15,000 $m^3$/hr of combustion exhaust gas (at 950° C.) from the auxiliary furnace, and this gaseous mixture was fed to the fluidized bed dryer.

Raw coal which had been crushed to a particle diameter of not greater than 1 inch was heated and dried at a raw coal feed rate of 7.4 t/hr and an average residence time of 4 minutes.

Properties of the dried coal were as follows.

Temperature: 96° C.

Total moisture: 7.8 wt. %

Calorific value (on an equilibrium moisture basis):

5,700 kcal/kg

Thus, by using relatively low-temperature exhaust gas from the boiler and exhaust gas from the auxiliary furnace, coal having a higher calorific value could be safely and economically produced from low-quality coal having a lower calorific value, in an amount greater than that required for self-consumption in the coal-fired boiler.

2. Second Group

In the second group of the present invention, the term "medium-quality or low-quality coal" refers to coal having a carbon content of not greater than 80% by weight on a dry ash-free (hereinafter referred to as "d.a.f.") basis, and an equilibrium moisture content of not less than 8% by weight. Specific examples thereof include brown coal and high-volatile sub-bituminous coal.

The moisture of medium-quality or low-quality coal consists of surface moisture and internal moisture (called "equilibrium moisture"). The surface moisture can be removed even by drying at 100° C. or below.

The internal moisture can be reduced to about one-half by drying at a temperature of 80 to 150° C. However, when dried by heating at 150° C. or below, medium-quality or low-quality coal does not undergo reforming, and the dried coal retains high hygroscopicity. Accordingly, if the dried coal is allowed to stand in the atmosphere, it will absorb atmospheric moisture and return to its original equilibrium moisture content.

On the other hand, when medium-quality or low-quality coal is heat-treated at a temperature of about 180 to 300° C., hydrophilic oxygen-containing groups such as phenol and carboxyl groups undergo thermal decomposition. Since such heating results in the removal of internal moisture present in the coal and the decomposition of hydrophilic oxygen-containing groups such as phenol and carboxyl groups, $H_2O$ and $CO_2$ are released. Thus, the coal becomes hydrophobic and hence shows a reduction in hygroscopicity. Moreover, owing to a reduction in the oxygen content of the coal, the coal becomes inactive and its spontaneous combustion is suppressed to some extent.

Moreover, the equilibrium moisture content begins to decrease when medium-quality or low-quality coal is heated to a temperature of 300° C. or above. At 350° C. or above, the equilibrium moisture content decreases markedly and reaches ½ or less of the level attained by ordinary drying. At the same time, tar present in the coal liquefies and oozes out to the surface through the pores of the coal. This is obvious from the observation of the coal surface by scanning electron microscopy and the measurement of specific surface area indicating a marked reduction in the specific surface area of the coal. For example, when raw coal having a specific surface area of 1.7 $m^2$/g is heat-treated at 430° C., its specific surface area is reduced to about 0.1 $m^2$/g.

That is, when medium-quality or low-quality coal is heated and then rapidly cooled, the tar having oozed out in the pores and on the coal surface solidifies and covers the coal surface, resulting in a reduction in the hygroscopicity and reactivity of the coal.

Moreover, when medium-quality or low-quality coal is heated to a temperature higher than 450° C. and up to about 500° C., the equilibrium moisture content is further reduced. However, it can be seen from the observation of the coal surface by scanning electron microscopy and the measurement of specific surface area that the coal surface is cracked and the specific surface area increases sharply to about 2.4 $m^2$/g.

When medium-quality or low-quality coal is heated to a temperature higher than 500° C., the coal becomes brittle and fragile. Thus, problems arise, for example, in that the coal cannot retain its shape stably and the production of finely powdered coal is increased.

Moreover, since a long heating time tends to cause the scattering of combustible materials such as tar and CO, it is preferable to heat coal at a rate of not less than 100° C. per minute. This makes it possible to prevent the loss of combustible materials and minimize the amount of combustible materials mixing in the hot gas for heating use.

Furthermore, if the gas used for the heating purpose has a high oxygen concentration, there is a risk that combustible materials present on the coal surface may be excessively oxidized (or lost), easily combustible materials may be ignited, or a coal dust explosion may occur. Accordingly, an inert gas having an oxygen concentration of not greater than 12% by volume, a hot gas mixed with not less than 10% by volume of steam, or steam alone is used for this purpose. It is most preferable to use a gas having an oxygen concentration of not greater than 4% by volume.

Since a long heating time tends to cause the scattering of combustible materials, cooling of the heated coal must be carried out rapidly. It is preferable to cool the heated coal rapidly to a temperature of 250° C. or less at a rate of not less than 50° C. per minute.

The gas used for the cooling purpose may comprise, for example, a gas before being used for the above-described heating purpose, or a gas obtained by cooling the gas having been used for the heating purpose by heat exchange.

The coal which is obtained by heating raw coal to a high temperature and then cooling it as described above and has been modified so as to exhibit properties (e.g., spontaneous combustibility, hygroscopicity and calorific value) different from those of the raw coal is called "reformed coal".

However, from the viewpoint of handleability, the reformed coal thus obtained cannot be said to have sufficient stability to prevent spontaneous combustion. The second group of the present invention is characterized in that such reformed coal is further subjected to an aging treatment.

This aging may be carried out by storing reformed coal for a predetermined period of time under such conditions that the average temperature of the reformed coal during storage is not higher than a predetermined temperature and the reformed coal is substantially isolated from the atmosphere or placed at a low oxygen concentration or under an atmosphere of an inert gas.

Generally, coal becomes more reactive with oxygen as the temperature rises. A temperature of 40-50° C. is regarded as a first warning temperature, and a temperature of 50-60° C. as a second warning temperature. If the temperature exceeds 70° C., the rate of reaction of coal with oxygen increases sharply. Consequently, the oxidation of coal proceeds slowly upon contact with air, and the resulting rise in temperature involves the risk of causing combustion. Accordingly, a temperature of about 70° C. is regarded as a first critical temperature for coal storage, and a temperature of about 80° C. as a second critical temperature for coal storage.

If the oxygen concentration is not greater than 12%, there is little risk of spontaneous combustion during storage. Moreover, if the passage of air is intercepted, the oxygen contained in the air is gradually consumed and the interior of the stored coal is maintained at an oxygen concentration of not greater than 21%. Accordingly, there is little risk of spontaneous combustion during storage.

Thus, in such a state that the layer of coal deposited for purposes of storage is cooled to 70° C., there is little risk of spontaneous combustion during storage even if the coal comes into contact with air. Moreover, if the passage of air is intercepted, there is little risk of spontaneous combustion during storage because the oxygen contained in the air is gradually consumed.

The above-described expression "the reformed coal is substantially isolated from the atmosphere or placed at a low oxygen concentration or under an atmosphere of an inert gas" means any of the following two combinations of conditions (a) and (b).

(a) A combination of an oxygen concentration of not greater than 12% by volume and a temperature of 100° C. or below, preferably a combination of an oxygen concentration of not greater than 12% by volume, a humidity of not greater than 60%, and a temperature of 100° C. or below.

(b) A combination of an oxygen concentration of not greater than 21% by volume and a temperature of 70° C. or below, preferably a combination of an oxygen concentration of not greater than 21% by volume, a humidity of not less than 60%, and a temperature of 70° C. or below.

The aging period of the reformed coal may be 1 month or more, preferably 2 months or more, and most preferably 3 months or more, though it depends on the above-described coal storage conditions. As a result of the aging, the spontaneous combustibility of the reformed coal during storage is improved.

More specifically, the aging may be carried out by placing reformed coal in storage equipment comprising a pit, a disused mine, a tunnel, receptacles, silos, a transport ship, vehicles or the like, and storing it for a predetermined period of time while intercepting or minimizing the passage of air and the inflow of rainwater and while monitoring the temperature, humidity and oxygen concentration in response to the amount of coal stored. More specifically, it is preferable to control these values by partitioning the stored coal into sections of suitable size and measuring the conditions of the upper, intermediate and lower parts of each section.

The storage equipment is provided with inert gas inlet (or circulation) pipes, blowers, heat exchangers for temperature control use, water sprinklers and the like.

The inert gas can be any of various gases having a low oxygen concentration, such as nitrogen gas, carbon dioxide gas, combustion exhaust gas, and gas obtained from the gas having been used for the reforming purpose by washing it with water and then cooling it to remove dust and tar.

Moreover, air may be used at sufficiently low temperatures. Furthermore, air may also be used under such conditions that the humidity is higher than a certain level and the temperature is lower than a certain level.

In order to intercept or minimize the passage or air and the inflow of rainwater, and in order to replace the atmosphere of the storage equipment by an inert gas or pass an inert gas through the storage equipment, various methods may be employed according to the type of the storage equipment. They include, for example, a method in which reformed coal is deposited in a depression formed at the site of coal mining and covered with a heat-resistant and water-resistant sheet; a method in which reformed coal is dumped into a pit and covered with raw coal, and the gas having been used for the reforming purpose and is washed with water and passed through the reformed coal from the bottom thereof; a method in which reformed coal is dumped into an inclined tunnel from its upper end, the shutter and the lower discharge port are closed, and an inert gas is introduced thereinto; a method in which receptacles such as drums, silos or gas holders are charged with reformed coal and tightly sealed; and a method in which reformed coal is loaded onto a transport ship and the combustion exhaust gas of the transport ship is cooled and passed therethrough during shipment.

Examples of the aforesaid heat-resistant and water-resistant sheet include canvas, various heat-resistant synthetic resin sheets, and metallic covers.

EXAMPLES 6-8

The second group of the present invention is more specifically explained with reference to the following examples. However, it is to be understood that the second group of the present invention is not limited thereto.

(1) Properties of Raw Coal, Dried Coal and Reformed Coal were Evaluated According to the Following Methods.

Equilibrium moisture: This was determined by placing a sample of heat-treated coal in a saturated saline solution desiccator (with a relative humidity of 75%) and then testing it according to JIS M8812.

Volatile matter: This was determined according to JIS M8812.

Calorific value: This was determined according to JIS M8814.

Specific surface area: This was measured with nitrogen gas according to the BET method.

Observation of coal surface: Using a scanning electron microscope, the coal surface was photographed at magnifications of 100 to 1,000 diameters.

(2) Storage Conditions and Spontaneous Combustibility Tests

During aging, the temperature, humidity and oxygen concentration of reformed coal were measured according to the following methods.

(a) Temperature: Temperature was measured with thermocouples (CA wires) disposed at intervals of 50 cm in the directions of the length, width and depth.

(b) Humidity and oxygen concentration: Sampling tubes were disposed at intervals of 50 cm on peripheral planes located 30 cm inside of the inner wall surfaces of the coal storage equipment, and also disposed in the center thereof at intervals of 50 cm in the direction of the depth. Gas samples were collected by suction through these sampling tubes and analyzed.

Spontaneous combustibility tests were performed by using a test apparatus 101 or 102.

(c) Method using test apparatus 101: A thermal insulation type spontaneous combustibility test apparatus in which there was no temperature difference between the sample and the ambient atmosphere was used. A dried coal sample which had been crushed to 200 mesh or less was charged into a sample chamber and heated to a predetermined base temperature by using nitrogen gas. Thereafter, the nitrogen gas was replaced by a gas having a testing oxygen concentration and changes in sample temperature were traced. Using the Arrhenius equation, the rate of temperature rise was determined from temperature rise data. The spontaneous combustibility of various sample coals was evaluated by comparison of their rates of temperature rise.

(d) Method using test apparatus 102: A dried coal sample which had been preheated to a test temperature was charged into a thermally insulated test apparatus having a diameter of about 30 cm. Then, a gas having a testing oxygen concentration and a controlled temperature was introduced thereinto at a controlled flow rate, and changes in sample temperature were traced by means of a group of thermocouples disposed within the apparatus. The spontaneous combustibility of various sample coals was evaluated by comparison of their temperature changes (i.e., their maximum rates of temperature rise).

Example 6

Coal mined in Canada was used as raw material. (According to the ASTM classification system, this coal belongs to the class of high-volatile bituminous coal.) Properties thereof are as shown below.

[Properties of Medium-quality or Low-quality Coal Used as Raw Material (after Removal of Surface Moisture)]

Equilibrium (internal) moisture: 11.0 wt. %

Ash: 10.2 wt. %

Volatile matter: 38.4 wt. %

Fixed carbon: 40.4 wt. %

Calorific value (on an equilibrium moisture basis): 5,700 kcal/kg

The raw coal was crushed to a particle diameter of not greater than 1 inch, ordinarily dried at 110° C. to remove surface moisture, and introduced into a fluidized bed for heat-treating use at a rate of 2 t/d. In this fluidized bed, the raw coal was rapidly heated to 400° C. at a heating rate of 100° C. per minute. Immediately after that, the heated coal was introduced into a fluidized bed for cooling use where it was rapidly cooled to 70° C. at a cooling rate of 50° C. per minute. The resulting coal was harvested as reformed coal. A furnace for generating hot gas for rapid heating use was operated by using kerosene as fuel, and the hot gas used for the heating purpose was adjusted to an oxygen concentration of not greater than 4% by volume with exhaust gas from the furnace.

The reformed coal discharged from the fluidized bed for cooling use was dumped into a depression measuring 5 m (length)×2 m (width)×2 m (depth) and free from incoming ground water, totally covered with canvas, and aged for 60 days.

During aging, the reformed coal had a temperature of 60° C., a humidity of 70% and an oxygen concentration of 15% as evaluated with the average atmosphere.

As to the moisture content of the aged reformed coal, a coal sample placed in a moisture measuring apparatus reached an equilibrium moisture content of 5.5% in about 5 days. This equilibrium moisture content was much lower than that of the raw coal, indicating a reduction in the hygroscopicity of the coal.

The aged reformed coal had a volatile content of 35% and a calorific value of 6,050 kcal/kg, and was suitable for transportation and use.

The resulting aged coal was subjected to two types of spontaneous combustibility tests, which showed a marked improvement in spontaneous combustibility.

The rate of temperature rise in test apparatus 101 was about 11° C./hr for the dried raw coal and about 4° C./hr for the as-reformed coal. In contrast, the rate of temperature rise of the aged coal was about 1.4° C./hr, indicating that the temperature rise property of the aged coal was reduced to ⅓ of that of the as-reformed coal.

Example 7

For testing purposes, the rapidly cooled reformed coal obtained in Example 6 was load in bulk into a steel tank simulating a tank of a transport ship. After the tank was tightly sealed, an inert gas having an oxygen concentration of about 5%, which simulated combustion exhaust gas having been used to obtain the power for the ship, was fed to the tank.

The atmosphere in which the reformed coal was placed for a period of 45 days corresponding to the period of shipment had an average temperature of 55° C., a humidity of 60%, and an oxygen concentration of 4%. The aged reformed coal had an equilibrium moisture content of 5.4%, a volatile content of 35%, and a calorific value of 6,100 kcal/kg. This aged reformed coal exhibited low hygroscopicity and a high calorific value, and was hence suitable for transportation and use.

The aged reformed was taken out of the tank, deposited at a coal yard of a thermal electric power plant, and allowed to stand for 3 months in summer. However, no spontaneous combustion occurred.

Example 8

Coal mined in the western part of the U.S.A. was used as raw material. Properties thereof are as shown below.

[Properties of Medium-quality or Low-quality Coal Used as Raw Material (after Removal of Surface Moisture)]

Equilibrium (internal) moisture: 23.7 wt. %

Ash: 6.8 wt. %

Volatile matter: 35.3 wt. %

Fixed carbon: 34.2 wt. %

Calorific value (on an equilibrium moisture basis): 4,820 kcal/kg

The raw coal was crushed to a particle diameter of not greater than 1 inch, ordinarily dried to remove surface moisture, and introduced into a fluidized bed for heat-treating use at a rate of 2.5 t/d. In this fluidized bed, the raw coal was rapidly heated to 280° C. Thereafter, the heated coal was introduced into a fluidized bed for cooling use where it was rapidly cooled to 150° C. The resulting coal was harvested as reformed coal. A furnace for generating hot gas for rapid heating use was operated by using kerosene as fuel, and the hot gas used for the heating purpose comprised exhaust gas from this furnace and had an oxygen concentration of not greater than 4% by volume.

The reformed coal discharged from the fluidized bed for cooling use was dumped into a concrete tunnel structure having an inner diameter of 3 m, a length of 5 m, and an angle of inclination of 60 degrees. Part of the gas having been used for the rapid heating purpose was washed with water and introduced into the tunnel from its lower end. Thus, the reformed coal was stored for 70 days under average conditions including a temperature of 50° C., a humidity of 60% and an oxygen concentration of 12%.

As to the moisture content of the aged reformed coal, a coal sample placed in a moisture measuring apparatus reached an equilibrium moisture content of 12% in about 5 days. This equilibrium moisture content was much lower than that of the raw coal, indicating a reduction in the hygroscopicity of the coal.

The aged reformed coal had a calorific value of 5,620 kcal/kg and was suitable for transportation and use.

The resulting aged coal was subjected to spontaneous combustibility tests, which showed a marked improvement in spontaneous combustibility.

Figure 2:
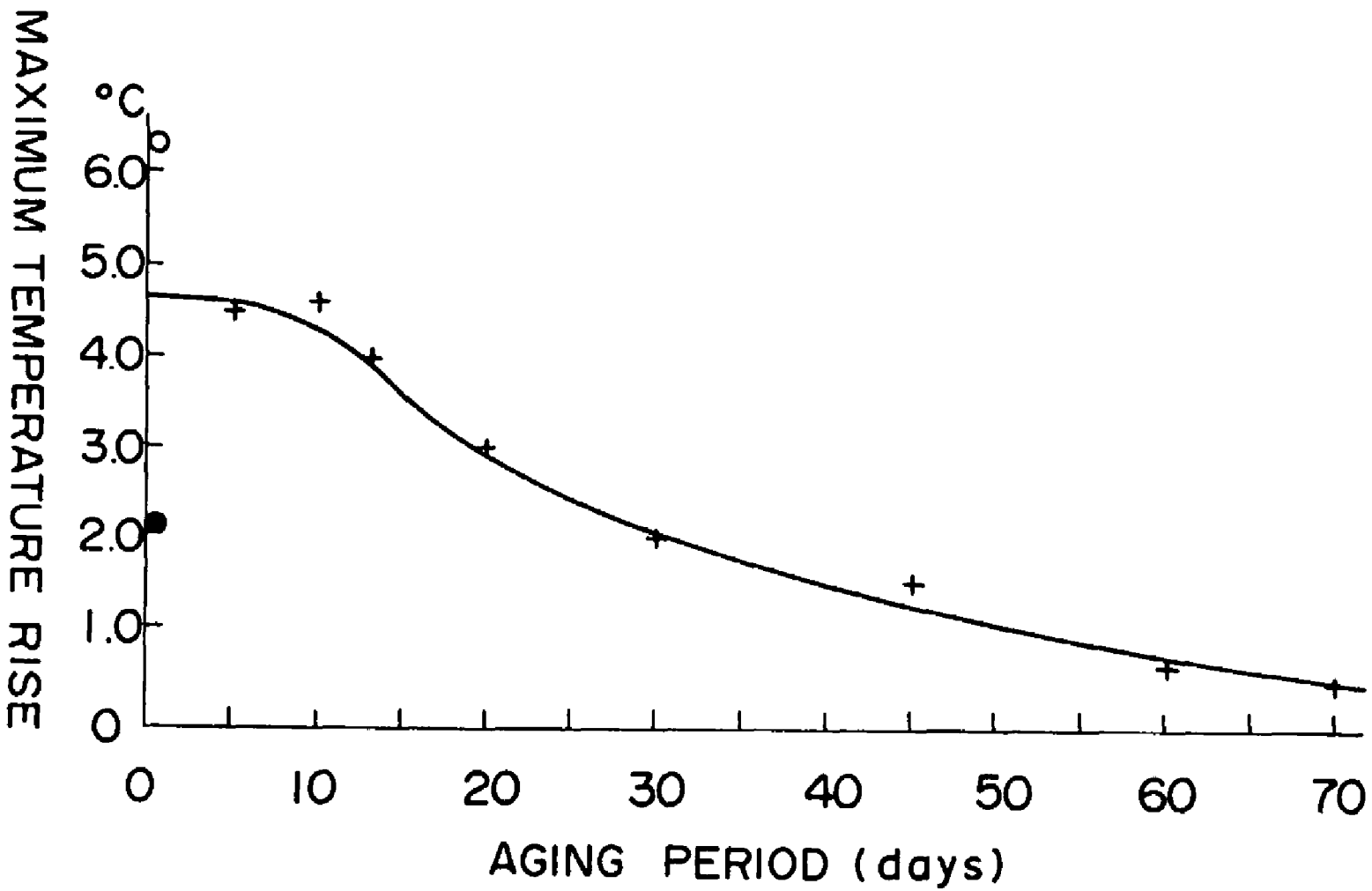
FIG. 2 is a graph showing the relationship between the aging period (in number of days) and the maximum temperature rise of reformed coal treated according to the second group of the present invention, in which ● represents the maximum temperature rise of undried raw coal, 0 represents the maximum temperature rise of dried raw coal, and + indicates the maximum temperature rise of reformed coal after the lapse of the indicated aging period.

During the aging period, changes in the maximum temperature rise of the reformed coal were measured by means of test apparatus 102, and the results thus obtained are shown in FIG. 2. Measurements were made at a base temperature of 70° C. by using air as the introduced gas.

It can be seen from this figure that the temperature rise property of the aged coal of 60-70 days was reduced to ⅛-⅙ of that of the as-reformed coal, about ¼ of that of the (undried) raw coal, and ⅒ of that of the dried coal.

3. Third Group

In the third group of the present invention, the term "medium-quality or low-quality coal" refers to coal having a total moisture content of not less than 10% by weight, a carbon content of not greater than 80% by weight on a dry ash-free (hereinafter referred to as "d.a.f.") basis, and an equilibrium moisture content of not less than 8% by weight. Specific examples thereof include brown coal and high-volatile sub-bituminous coal.

The moisture of medium-quality or low-quality coal consists of surface moisture and internal moisture (called "equilibrium moisture"). The surface moisture can be removed even by drying at 100° C. or below.

The moisture content of coal can be reduced to about one-half of the equilibrium moisture content by drying at a temperature of 80 to 150° C. However, when dried by heating at 150° C. or below, medium-quality or low-quality coal does not undergo reforming, and the dried coal retains high hygroscopicity. Accordingly, if the dried coal is allowed to stand in the atmosphere, it will absorb atmospheric moisture and return to its original equilibrium moisture content.

On the other hand, when medium-quality or low-quality coal is heat-treated at a temperature of about 180 to 300° C., hydrophilic oxygen-containing groups such as phenol and carboxyl groups undergo thermal decomposition. Since such heating results in the removal of internal moisture present in the coal and the decomposition of hydrophilic oxygen-containing groups such as phenol and carboxyl groups, $H_2O$ and $CO_2$ are released. Thus, the coal becomes hydrophobic and hence shows a reduction in hygroscopicity. Moreover, owing to a reduction in the oxygen content of the coal, the coal becomes inactive and its spontaneous combustion is suppressed to some extent.

Moreover, the equilibrium moisture content begins to decrease when medium-quality or low-quality coal is heated to a temperature of 300° C. or above. At 350° C. or above, the equilibrium moisture content decreases markedly and reaches ½ or less of the level attained by ordinary drying. At the same time, tar present in the coal liquefies and oozes out to the surface through the pores of the coal. This is obvious from the observation of the coal surface by scanning electron microscopy and the measurement of specific surface area indicating a marked reduction in the specific surface area of the coal. For example, when raw coal having a specific surface area of 1.7 $m^2/g$ is heat-treated at 430° C. and then rapidly cooled, its specific surface area is reduced to about 0.1 $m^2/g$.

It is believed that, when the tar having spread through the pores and over parts of the coal surface solidifies, this not only decreases the specific surface area of the coal and inactivates it, but also reduces hygroscopicity and spontaneous combustibility.

Moreover, when medium-quality or low-quality coal is heated to a temperature higher than 450° C. and up to about 500° C., the equilibrium moisture content is further reduced. However, as can be seen from the observation of the coal surface by scanning electron microscopy and the measurement of specific surface area, it has been found that the coal surface is severely cracked and the specific surface area increases sharply to about 2.4 $m^2/g$.

When medium-quality or low-quality coal is heated to a temperature higher than 500° C., the coal is more severely cracked and becomes brittle. Thus, problems arise, for example, in that the production of finely powdered coal is increased.

Moreover, since a long heating time tends to cause the scattering of combustible materials such as tar and CO, the step of reforming raw coal by heating to a temperature of 300 to 500° C. should preferably be carried out at a heating rate of not less than 100° C. per minute. This makes it possible to prevent the loss of combustible materials present in the coal and minimize the amount of combustible materials mixing in the hot gas for heating use.

Furthermore, if the gas used for the heating purpose has a high oxygen concentration, there is a risk that easily combustible materials may be ignited or a coal dust explosion may occur. Accordingly, an inert gas having an oxygen concentration of not greater than 12% by volume, a hot gas mixed with not less than 10% by volume of steam, or steam alone is used for this purpose. It is most preferable to use a gas having an oxygen concentration of not greater than 4% by volume. For example, it is desirable from the viewpoint of oxygen concentration and temperature to use hot exhaust gas from a coal-fired boiler and, in particular, exhaust gas obtained at the outlet of the economizer or denitrator for the coal-fired boiler.

Since a long heating time tends to cause the scattering of combustible materials, cooling of the heated coal must also be carried out rapidly. When raw coal is reformed by heating to a temperature of 300 to 500° C., it is preferable to cool the heated coal to a temperature of 250° C. or less at a rate of not less than 50° C. per minute.

The gas used for the cooling purpose may comprise, for example, exhaust gas having passed through the electrostatic precipitation step, or exhaust gas having passed through the desulfurization step.

The reformed coal which is obtained by heating raw coal to a high temperature and then cooling it as described above shows a reduction in spontaneous combustibility, but retains its good ignitability. Accordingly, this reformed coal can be directly used as fuel for conventional coal-fired boilers.

According to the third group of the present invention, raw coal is treated in three stages. In the first stage, raw coal is dried by using exhaust gas having been used for the reforming purpose. In the second stage, the dried coal is heated and reformed by using hot exhaust gas from a coal-fired boiler and, in particular, exhaust gas obtained at the outlet of the economizer or denitrator for the coal-fired boiler. In the third stage, the coal treated at high temperature is cooled by using exhaust gas obtained at the outlet of the dust collector (e.g., electrostatic precipitator) and/or desulfurizer included in the equipment for treating exhaust gas from the coal-fired boiler or a gaseous mixture composed of such exhaust gas and air.

Moreover, in order to increase the production of reformed coal or enhance the reforming effect, the coal-fired boiler may be equipped with an auxiliary furnace. By using hot exhaust gas from the auxiliary furnace in admixture with exhaust gas obtained at the outlet of the economizer or a point downstream thereof, the production of reformed coal may be increased, or the degree of reforming may be enhanced to yield coal beneficial to consumers. Thus, there can be obtained reformed coal for commercial use.

Moreover, hot dried coal or finely powdered coal collected by a collector may be fed directly, without substantially cooling it, to the furnace of the coal-fired boiler, or both the furnace of the coal-fired boiler and the auxiliary furnace, for purposes of self-consumption. Thus, high thermal efficiency can be achieved because such coal may be used in a heated state and without any reduction in calorific value due to moisture absorption during storage.

When the aforesaid auxiliary furnace is installed, all or part of the exhaust gas having been used for the drying purpose may be fed to the auxiliary furnace. Thus, organic combustible materials present in this exhaust gas may be burned in the auxiliary furnace.

The dryer, reformer and cooler used for these purposes should preferably be of the continuous type. There may be used any of various dryers such as fluidized bed dryers, circulation dryers and rotary kiln dryers.

First, the drying step is explained. Where a fluidized bed dryer is used, it is preferable to dry raw coal after it is crushed to a particle size of 0.1 to 2 inches.

The gas used for the drying purpose should have a temperature of 150 to 350° C. and an oxygen concentration which is as low as possible from the viewpoint of safe operation. Especially preferred is an oxygen concentration of not greater than 4% as is the case with exhaust gas. Accordingly, in usual practice, the exhaust gas having been used for the reforming purpose is used as such. However, exhaust gas from the coal-fired boiler equipment may be used in admixture with it.

In the fluidized bed dryer, the superficial gas velocity is suitably in the range of 4 to 10 m/sec, and the residence time is suitably in the range of about 2 to 10 minutes.

The resulting dried coal has a temperature of 80 to 105° C. and a moisture content of about 6 to 12% by weight.

The exhaust gas having been used for the drying purpose is freed of relatively coarse particles by means of a cyclone or the like, and then fed to the denitration or electrostatic precipitation step of the coal-fired boiler equipment. Thus, exhaust gas and dust can be prevented from being discharged into the atmosphere. The coal particles separated by the cyclone or the like are fed to the coal-fired boiler as fuel therefor.

The resulting dried coal is fed to the reforming step. Alternatively, part of the dried coal may be fed, without substantially cooling it, to the coal-fired boiler (and the auxiliary furnace) for purposes of self-consumption. For this purpose, it is common practice to pulverize the dried coal in a pulverizer and feed the pulverized coal to the burner by pneumatic conveyance.

Next, the reforming and cooling steps are explained. The dried coal obtained as described above is fed, for example, to a fluidized bed reformer. In this reformer, reformed coal is produced by heating the dried coal to a temperature of 180 to less than 300° C. and then cooling it to a temperature of 150° C. or below or by heating the dried coal to a temperature of 300 to 500° C. at a heating rate of not less than 100° C. per minute and then cooling it to a temperature of 250° C. or below at a cooling rate of not less than 50° C. per minute.

The gas used for the reforming purpose should have a temperature of 200 to 600° C. and an oxygen concentration of not greater than about 12% by volume. The oxygen concentration should preferably be as low as possible, and most preferably not greater than 4% as is the case with exhaust gas. Accordingly, it is advantageous to produce reformed coal by utilizing a coal-fired boiler installed at the site of coal mining and using exhaust gas obtained at the outlet of the economizer or denitrator therefor.

In the fluidized bed reformer, the superficial gas velocity and the residence time may be determined according to the particle size of the raw coal and the reforming conditions.

In order to cool the reformed coal obtained in the reforming step, the reformed coal may be fed to a fluidized bed apparatus similar to that used in the drying step, and cooled by using a gas having a low temperature and a low oxygen concentration, such as exhaust gas obtained at the outlet of the electrostatic precipitation or desulfurization step of the coal-fired boiler equipment. In some cases, a gas cooled by air may be used for the cooling purpose.

In the fluidized bed cooler, the superficial gas velocity and the residence time may be determined according to the cooling conditions.

After cooling, the reformed coal usually has an equilibrium moisture content of 8 to 20% by weight and a calorific value of 4,500 to 6,500 kcal/kg, and is characterized by a high calorific value, low hygroscopicity and low spontaneous combustibility.

Figure 3:
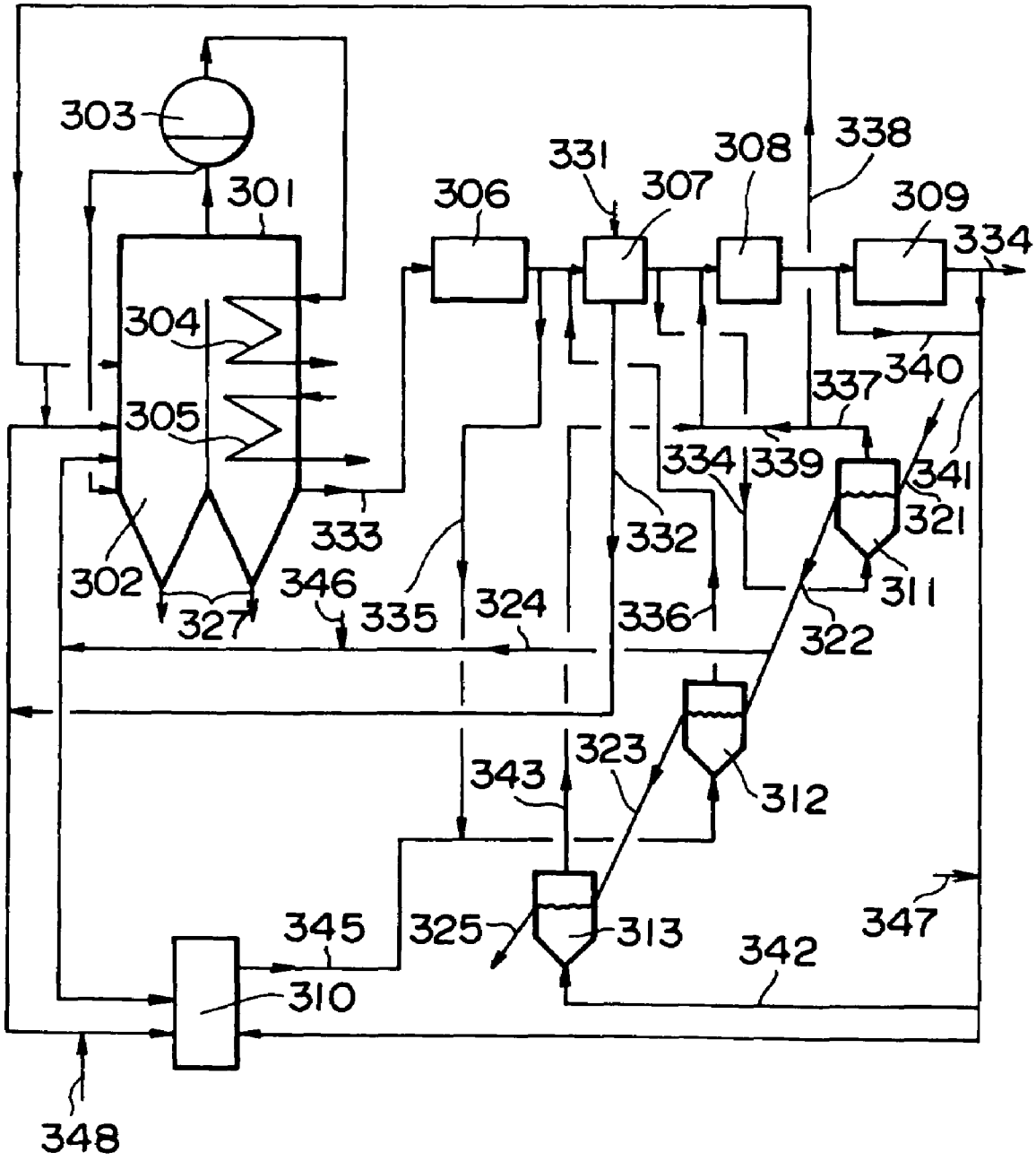
FIG. 3 is a block flow sheet illustrating one embodiment of the process for producing reformed coal in accordance with the third group of the present invention.

Now, one embodiment of the third group of the present invention is described below with reference to FIG. 3.

In a coal-fired boiler 301, combustion gas causes steam to be generated in steam generating tubes disposed within a furnace 302. (The generated steam is subject to gas-liquid separation in a steam drum 303. The separated steam is passed through a superheater 304. After the superheated steam is used to drive a steam turbine, the resulting condensate is recycled to the water tubes of furnace 302 and evaporated again.) After superheating the steam in superheater 304, the combustion gas passes through an economizer 305 where it heats feedwater for the coal-fired water. The resulting economizer outlet exhaust gas 333 is passed through a flue gas denitrator 306 as required, and fed to an air heater 307 for heating air 331 by heat exchange. Thereafter, the exhaust gas is fed to an electrostatic precipitator 308 and then to a desulfurizer 309, and discharged into the atmosphere 344. In this embodiment, all or part of the economizer outlet exhaust gas 333 (or the flue gas denitrator outlet gas when a flue gas denitrator is installed) is used as reforming exhaust gas 335 and fed to a reformer 312. Combustion air 332 heated by heat exchange in the aforesaid air heater 307 is used as combustion air for the coal-fired boiler (and as part of the combustion air for the auxiliary furnace).

Medium-quality or low-quality coal 321 used as raw material is fed to a fluidized bed dryer 311 where it is dried with drying exhaust gas 334 to evaporate the surface moisture and part of the internal moisture. The resulting dried coal 322 is fed to a fluidized bed reformer 312 where it is heated by the aforesaid reforming exhaust gas 335. The resulting hot reformed coal 323 is fed to a fluidized bed cooler 313 where it is cooled to yield a reformed coal product 325. On the other hand, exhaust gas 343 is discharged therefrom. Part of the dried coal 322 is fed to furnace 302 as hot dried coal 324 for self-consumption. In this process, it is preferable that exhaust gas 342 used for the cooling purpose comprise exhaust gas 340 from electrostatic precipitator 308 or exhaust gas 341 from desulfurizer 309, because they have a low temperature and a low oxygen concentration. Moreover, air 347 for temperature control use is also supplied.

Exhaust gas 337 having been used for the drying purpose is freed of relatively coarse particles by means of a cyclone (not shown), and may then be fed to electrostatic precipitator 308 of the coal-fired boiler equipment as exhaust gas 339, or mixed with combustion air for the coal-fired boiler as exhaust gas 338. The particles separated by the cyclone, together with fuel coal, is passed through a pulverizer (not shown) and used as fuel for coal-fired boiler 301. Furnace 302 and auxiliary furnace 310 are fed with coal 346. Ash 327 is discharged from the bottom of coal-fired boiler 301.

Moreover, according to another embodiment of the third group of the present invention, the coal-fired boiler is equipped with an auxiliary furnace 310, and hot exhaust gas 345 from the auxiliary furnace is mixed with reforming exhaust gas 335. Thus, it is possible to increase the reforming throughput of medium-quality or low-quality coal, and thereby increase the production of cooled reformed coal 325 for commercial use or produce coal having a higher degree of reforming. Hot exhaust gas 345 from auxiliary furnace 310, which has an oxygen concentration of not greater than 5% by volume, is fed to reformer 312, either as such or after being diluted with exhaust gas obtained at the outlet of the economizer of the coal-fired boiler or a point downstream thereof. Where exhaust gas 337 having been used for the drying purpose contains a large amount of combustible materials, part of the gas may be treated by feeding it to furnace 302 or auxiliary furnace 310.

Instead of being fed to the reformer in order to produce reformed coal, part of the dried coal may be fed directly, without substantially cooling it, to furnace 302 or auxiliary furnace 310 and may be advantageously burned therein from the viewpoint of thermal efficiency.

Consequently, by installing the dryer in close vicinity to the feed port of a pulverizer having a means for pneumatically conveying coal to the furnace, it is possible to dry the amount of raw coal required for use as fuel for the coal-fired boiler, feed the dried coal directly to the furnace, and burn it therein.

EXAMPLES 9-14

The third group of the present invention is more specifically explained with reference to the following examples. However, it is to be understood that the third group of the present invention is not limited thereto.

Properties of raw coal, dried coal and reformed coal were evaluated according to the following methods.

Equilibrium moisture: This was determined by placing a sample of heat-treated coal in a saturated saline solution desiccator (with a relative humidity of 75%) and then testing it according to JIS M8812.

Volatile matter: This was determined according to JIS M8812.

Calorific value: This was determined according to JIS M8814.

Specific surface area: This was measured with nitrogen gas according to the BET method.

Observation of coal surface: Using a scanning electron microscope, the coal surface was photographed at magnifications of 100 to 1,000 diameters.

Example 9

The coal used as raw material was medium-quality coal mined in Canada. According to the ASTM classification system, this belongs to the class of high-volatile bituminous coal, and properties thereof are shown in Table 1.

The raw coal was crushed to a particle diameter of not greater than 1 inch, and fed to the fluidized bed dryer where it was dried at a coal temperature of about 100° C. by using exhaust gas from the reformer. Of the resulting dried coal, the finely powdered portion having escaped from the dryer was collected by means of a cyclone and self-consumed as fuel coal for the coal-fired boiler. The remainder was fed to the reformer where it was rapidly heated to a coal temperature of 300° C. at a heating rate of about 100° C. per minute by using exhaust gas obtained at the outlet of the denitrator. Immediately after that, the heated coal was conveyed and fed to the fluidized bed cooler where it was rapidly cooled to 80° C. at a cooling rate of 50° C. per minute by using exhaust gas having passed through the desulfurizer. Thus, there was obtained reformed coal. The treating conditions and the results are shown in Table 1.

The reformed coal had a high calorific value and low hygroscopicity. Moreover, it had low spontaneous combustibility without involving no practical problem with ignitability, and was hence suitable for transportation and use.

Example 10

The coal used as raw material was low-quality coal mined in the western part of the U.S.A., and properties thereof are shown in Table 1.

The raw coal was crushed to a particle diameter of not greater than 1 inch, and fed to the fluidized bed dryer where it was dried at a coal temperature of about 100° C. by using exhaust gas from the reformer. Of the resulting dried coal, the finely powdered portion collected by means of a cyclone was self-consumed as fuel for the coal-fired boiler. The remainder was fed to the reformer where it was rapidly heated to a coal temperature of 290° C. by using exhaust gas obtained at the outlet of the economizer. Thereafter, the heated coal was conveyed to the fluidized bed cooler where it was cooled to 70° C. by using exhaust gas having passed through the desulfurizer. Thus, there was obtained reformed coal. The treating conditions and the results are shown in Table 1.

The reformed coal had a high calorific value, low hygroscopicity and good ignitability. Moreover, it was suitable for transportation and use.

Example 11

The same raw coal as used in Example 10 was crushed to a particle diameter of not greater than 1 inch, and fed to the fluidized bed dryer where it was dried at a coal temperature of about 100° C. by using exhaust gas from the reformer. Of the resulting dried coal, the portion collected by means of a cyclone was self-consumed as fuel coal for the coal-fired boiler. The remainder was fed to the reformer where it was rapidly heated to a coal temperature of 350° C. at a heating rate of about 100° C. per minute by using a gaseous mixture composed of exhaust gas obtained at the outlet of the denitrator and exhaust gas from the auxiliary furnace. Immediately after that, the heated coal was conveyed to the fluidized bed cooler where it was rapidly cooled to 100° C. at a cooling rate of 50° C. per minute by using exhaust gas having passed through the desulfurizer and air. Thus, there was obtained reformed coal. The treating conditions and the results are shown in Table 1.

The reformed coal had a high calorific value and low hygroscopicity, and exhibited little cracking. Moreover, it had low spontaneous combustibility in spite of its good ignitability, and was hence suitable for transportation and use.

Example 12

The procedure of Example 9 was repeated, except that after the exhaust gas having been used for the drying purpose was freed of relatively coarse particles by means of a cyclone, one half of the exhaust gas was fed to the electrostatic precipitator included in the equipment for treating exhaust gas from the coal-fired boiler while the other half was treated by mixing it with combustion air for the furnace of the coal-fired boiler, in order to reduce the $NO_x$ concentration according to the exhaust gas recirculation method. Thus, substantially the same reformed coal was obtained. The denitration, dedusting and desulfurization steps included in the equipment for treating exhaust gas from the coal-fired boiler could treat exhaust gas without any problem.

Example 13

The same type of coal-fired boiler as used in Example 9 and reformed coal production equipment comprising a dryer, a reformer and a cooler were installed at the side of mining of the raw coal used in Example 9. Moreover, an auxiliary furnace for generating a reforming gas was also installed in order to increase the production of reformed coal.

Properties of exhaust gas from the auxiliary furnace were as follows.

Temperature: 980° C.

Oxygen: 11 vol. %

Moisture: 7.5 vol. %

5,000 $m^3$/hr of exhaust gas branching off at the outlet of the economizer of the coal-fired boiler was mixed with 1,100 $m^3$/hr of exhaust gas from the auxiliary furnace, and this gaseous mixture was fed to the fluidized bed reformer.

Other treating conditions and the results are shown in Table 1.

Thus, substantially the same reformed coal as that obtained in Example 1 was obtained.

TABLE 1

| | Example 9 | Example 10 | Example 11 | Example 13 |
|---|---|---|---|---|
| Raw coal | | | | |
| Charge amount (t/hr) | 1.0 | 1.0 | 0.8 | 1.3 |
| Total moisture (wt. %) | 20.5 | 29.6 | 29.6 | 20.5 |
| Equilibrium moisture (wt. %) | 11.0 | 23.7 | 23.7 | 11.0 |
| Ash (wt. %) | 10.2 | 6.8 | 6.8 | 10.2 |
| Volatile matter (wt. %) | 38.4 | 35.3 | 35.3 | 38.4 |
| Fixed carbon (wt. %) | 40.4 | 34.2 | 34.2 | 40.4 |
| Calorific value (kcal/kg) | 5700 | 4820 | 4820 | 5700 |
| Dried coal for reforming | | | | |
| Temperature (° C.) | 93 | 90 | 93 | 95 |
| Total moisture (wt. %) | 6.3 | 8.2 | 7.1 | 4.7 |
| Reforming exhaust gas | | | | |
| Feed rate ($m^3$/hr) | 4500 | 5000 | 4100 | 6000 |
| Temperature (° C.) | 402 | 383 | 485 | 450 |
| Oxygen (vol. %) | 4.1 | 5.0 | 5.2 | 6.6 |
| Moisture (vol. %) | 12.5 | 14.3 | 14.0 | 10.8 |
| Cooling exhaust gas | | | | |
| Feed rate ($m^3$/hr) | 10500 | 19500 | 4500 | 31000 |
| Temperature (° C.) | 63 | 60 | 62 | 63 |
| Oxygen (vol. %) | 7.1 | 8.0 | 7.5 | 6.9 |
| Reformed coal after cooling | | | | |
| Amount (t/hr) | 0.75 | 0.6 | 0.5 | 1.0 |
| Temperature (° C.) | 80 | 70 | 100 | 72 |
| Equilibrium moisture (wt. %) | 6.8 | 11.3 | 10.2 | 6.0 |
| Ash (wt. %) | 10.7 | 8.0 | 8.0 | 11.5 |
| Volatile matter (wt. %) | 40.2 | 41.1 | 42.0 | 40.1 |
| Fixed carbon (wt. %) | 42.3 | 40.0 | 40.3 | 42.6 |
| Calorific value (kcal/kg) | 5970 | 5650 | 5860 | 6000 |
| Spontaneous combustibility (° C./hr) (in an atmosphere of air at 100° C.) | 4 | 5 | 4 | 4 |

Example 14

The procedure of Example 13 was repeated, except that after the exhaust gas having been used for the drying purpose was freed of relatively coarse particles by means of a cyclone, one half of the exhaust gas was treated by mixing it with combustion gas from the auxiliary furnace while the other half was treated partly by feeding it to the electrostatic precipitator included in the equipment for treating exhaust gas from the coal-fired boiler and partly by mixing it with combustion air for the furnace of the coal-fired boiler. Thus, substantially the same reformed coal was obtained. The denitration, dedusting and desulfurization steps included in the equipment for treating exhaust gas from the coal-fired boiler could treat exhaust gas without any problem.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

The entire disclosure of Japanese Patent Application No. 9-96583 filed on Mar. 31, 1997 including specification, claims, drawings and summary are incorporated herein by reference in its entirety.

The entire disclosure of Japanese Patent Application No. 9-96582 filed on Mar. 31, 1997 including specification, claims, drawings and summary are incorporated herein by reference in its entirety.

The entire disclosure of Japanese Patent Application No. 9-96584 filed on Mar. 31, 1997 including specification, claims, drawings and summary are incorporated herein by reference in its entirety.

The invention claimed is:

1. A method for aging reformed coal produced by heating medium-quality or low-quality coal to a temperature of 180 to less than 300° C. and then cooling it to a temperature of 150° C. or below or by heating medium-quality or low-quality coal to a temperature of 300 to 500° C. at a heating rate of not less than 100° C. per minute and then cooling it to a temperature of 250° C. or below at a cooling rate of not less than 50° C. per minute, which comprises storing the reformed coal for 1 month or more under any of the following atmospheres (a) or (b):

(a) An atmosphere having an oxygen concentration of not greater than 12% by volume and a temperature of 100° C. or below;

(b) An atmosphere having an oxygen concentration of not greater than 21% by volume and a temperature of 70° C. or below.

2. Aged reformed coal obtained by heating medium-quality or low-quality coal to a temperature of 180 to less than 300° C. and then cooling it to a temperature of 150° C. or below or by heating medium-quality or low-quality coal to a temperature of 300 to 500° C. at a heating rate of not less than 100° C. per minute and then cooling it to a temperature of 250° C. or below at a cooling rate of not less than 50° C. per minute; and storing the resulting reformed coal for 1 month or more under any of the following atmospheres (a) or (b):

(a) An atmosphere having an oxygen concentration of not greater than 12% by volume and a temperature of 100° C. or below;

(b) An atmosphere having an oxygen concentration of not greater than 21% by volume and a temperature of 70° C. or below.

* * * * *